United States Patent [19]

Childeric

[11] 4,146,815

[45] Mar. 27, 1979

[54] REVOLVING ANODE FOR AN X-RAY TUBE FILLED WITH LIQUID METAL

[75] Inventor: Bruno Childeric, Grenoble, France

[73] Assignee: Eurotungstene, Grenoble, France

[21] Appl. No.: 863,528

[22] Filed: Dec. 22, 1977

[30] Foreign Application Priority Data

Jan. 10, 1977 [FR] France ..... 77 00958

[51] Int. Cl.[2] ..... H01J 35/10

[52] U.S. Cl. ..... 313/330; 313/352

[58] Field of Search ..... 313/330, 60, 352

[56] References Cited

U.S. PATENT DOCUMENTS

| | | | |
|---|---|---|---|
| 1,615,994 | 2/1927 | Morrison | 313/330 |
| 3,711,736 | 1/1973 | Gabbay | 313/330 |
| 3,719,847 | 3/1973 | Webster | 313/60 |
| 3,959,685 | 5/1976 | Konieczynski | 313/60 X |

*Primary Examiner*—Alfred E. Smith
*Assistant Examiner*—Charles F. Roberts
*Attorney, Agent, or Firm*—Dennison, Dennison, Meserole & Pollack

[57] ABSTRACT

A revolving anode for an X-ray tube comprising a hollow rotating shell including a support composed of molybdenum or molybdenum-based alloy and a thin layer of tungsten, the shell being filled with liquid metal or alloy such as sodium. The zone of impact of the electrons on the shell essentially comprises the layer of tungsten or tungsten alloy in direct contact with the liquid metal.

3 Claims, 1 Drawing Figure

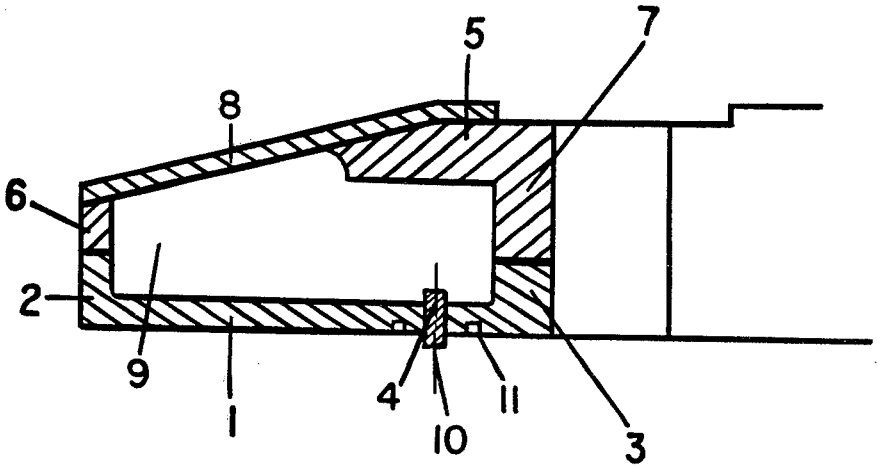
5
7
8
6
2
9
1
4
10
11
3

REVOLVING ANODE FOR AN X-RAY TUBE FILLED WITH LIQUID METAL

BACKGROUND OF THE INVENTION

The present invention relates to revolving anodes for X-ray tubes comprising a hollow shell filled with a liquid metal or alloy.

In order to improve the thermal capacity of revolving anodes for X-ray tubes, it has already been suggested that they be produced in the form of a hollow revolving shell with thin walls composed of refractory metal or alloy, for example tungsten, possibly alloyed with rhenium; this hollow shell being filled with a metal or alloy which is liquid or becomes liquid at a relatively low temperature, such as sodium. Such anodes are described, in particular, in French Pat. No. 2,082,406, corresponding to U.S. Pat. No. 3,711,736, and in U.S. Pat. No. 3,719,847.

Unfortunately, it has been very difficult to implement this concept, and, manufacture has therefore been very limited up until the present invention. In fact, it has turned out to be very difficult to weld or braze two brackets composed of tungsten or one bracket composed of tungsten with one bracket composed of another refractory material such as molybdenum or tantalium so as to produce a completely sealed shell.

SUMMARY OF THE INVENTION

The object of the present invention is to avoid this disadvantage and to allow such anodes to be manufactured industrially, both reliably and economically, with the anode being perfectly sealed and the cooling of the zone of impact of the electrons being ensured particularly well.

According to the invention, a revolving anode for an X-ray tube consists of a revolving hollow shell comprising a molybdenum or molybdenum alloy support with a thin layer of tungsten or tungsten alloy, and filled with a metal or alloy which is liquid or liquefies at a relatively low temperature, such as sodium. The zone of impact of the electrons is comprised essentially of the layer of tungsten or tungsten alloy in direct contact with the liquid metal.

DRAWING DESCRIPTION

The single FIGURE shows a partial section along an axial plane of a non-limiting example of an anode according to the invention.

DESCRIPTION OF PREFERRED EMBODIMENT

The lower bracket 1 is a disc composed of pure molybdenum or of a molybdenum-based alloy produced from a blank obtained by powder metallurgy techniques.

In the part situated on the perimeter of the anode and in the part adjacent to the axis, the final form comprises two annular rims 2 and 3, the upper surfaces of which are located in the same plane, perpendicular to the rotational axis. This form, as well as the densifying of the blank, is obtained by forging or by rotary extrusion of the blank. A filling orifice 4 is provided in the lower part of the lower bracket.

In order to produce the upper bracket 5, a composite disc comprising a support composed of molybdenum or molybdenum-based alloy covered with a thin layer of tungsten or of tungsten-based alloy is firstly manufactured by co-sintering powders of these materials. The thickness of this layer may vary between 0.2 and 2 mm, depending upon the size of the anode to be manufactured.

This composite disc is then transformed by forging and machining so as to obtain the final form. Two annular rims 6 and 7 are formed by forging from the side of the molybdenum support and are situated on the periphery of the disc and on the part adjacent to the axis respectively. The lower surfaces of the rims are situated in the same plane perpendicular to the rotational axis as the upper surfaces of the rims 2 and 3 of the lower bracket so as to allow the two brackets to be welded on these planar surfaces perpendicular to the axis.

The majority of the molybdenum remaining beneath the layer of tungsten is removed by machining from the zone of impact of the electrons 8 which will be subjected to the greatest thermal stresses during operation, so as to retain almost nothing but this layer of tungsten in this zone. The molybdenum is retained about the peripheries of the zone and in the areas of the rims 6 and 7.

The two brackets are then welded together by electron bombardment on the surfaces facing the rims 2–3 and 6–7. Welding may be carried in a single operation owing to judicious regulation of the electron gun and the thickness to be welded. This welding process is therefore only carried out between the molybdenum or molybdenum alloy areas.

The anode is then filled with liquid sodium 9 with the aid of the orifice 4 situated in the lower part of the lower bracket 1. A certain volume of vacuum is left to allow this metal to dilate freely.

The hole is blocked by using a stopper 10 composed of molybdenum which is then sealed onto the orifice 4 by electron bombardment.

In order to prevent sodium vapors from forming, an annular throat 11 is advantageously provided round the orifice 4.

An anode produced according to the invention is perfectly sealed and allows excellent heat transfer to be obtained in the zone of impact of the electrons owing to the direct contact between the liquid sodium and the thin layer of tungsten. This ensures effective cooling and good equilibrium of the thermal stresses in the shell and thus good dimensional stability of the anode.

What is claimed is:

1. A revolving anode for an X-ray tube comprising a hollow rotating shell including a support composed of molybdenum or molybdenum-based alloy and a thin layer of tungsten, the shell being filled with a metal or alloy which is liquid or liquefies at a relatively low temperature, the zone of impact of the electrons comprises essentially the layer of tungsten or tungsten alloy in direct contact with the liquid metal.

2. The anode of claim 1 wherein the liquid metal is sodium.

3. The anode of claim 1 wherein the shell comprises opposed brackets of molybdenum or molybdenum-based alloy, one of said brackets constituting said support, said support having molybdenum areas thereon in direct contact with the second bracket, with the support and the second bracket being joined by welding in the areas of contact.

* * * * *